US010366648B2

(12) United States Patent
Shimizu

(10) Patent No.: US 10,366,648 B2
(45) Date of Patent: Jul. 30, 2019

(54) SEMICONDUCTOR INTEGRATED CIRCUIT, TIMING CONTROLLER, AND DISPLAY DEVICE

(71) Applicant: ROHM CO., LTD., Ukyo-Ku, Kyoto (JP)

(72) Inventor: Takashi Shimizu, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 464 days.

(21) Appl. No.: 15/291,405

(22) Filed: Oct. 12, 2016

(65) Prior Publication Data

US 2017/0110040 A1 Apr. 20, 2017

(30) Foreign Application Priority Data

Oct. 14, 2015 (JP) ..... 2015-203167
Oct. 4, 2016 (JP) ..... 2016-196718

(51) Int. Cl.
*G09G 3/20* (2006.01)

(52) U.S. Cl.
CPC ..... *G09G 3/2092* (2013.01); *G09G 2330/12* (2013.01); *G09G 2370/08* (2013.01); *G09G 2370/14* (2013.01)

(58) Field of Classification Search
CPC .. G09G 3/006; G09G 3/2092; G09G 2310/08; G09G 2330/12; G09G 2370/08; G09G 2370/14; G01R 31/02; G01R 31/024; G01R 31/025; G01R 31/026; G01R 31/28
USPC ..... 324/750.3, 760.01
See application file for complete search history.

(56) References Cited

U.S. PATENT DOCUMENTS 9,967,104 B2 * 5/2018 Gardner ..... G01R 31/024
2012/0151289 A1 * 6/2012 Rodriguez ..... G01R 31/02 714/738
2014/0329339 A1 * 11/2014 Chaji ..... G01R 31/26 438/10
2016/0127084 A1 * 5/2016 Jansen ..... H04L 1/20 375/224

FOREIGN PATENT DOCUMENTS

JP 2006278797 A 10/2006

* cited by examiner

*Primary Examiner* — Jeff W Natalini
*Assistant Examiner* — Steven L Yeninas
(74) *Attorney, Agent, or Firm* — Cantor Colburn LLP

(57) ABSTRACT

A semiconductor integrated circuit connected to another circuit via differential transmission lines of N channels (where N is a natural number), the circuit includes: N pairs of differential output pins each of which is connected to a differential transmission line of a corresponding channel; N differential transmitters each of which is configured to drive a differential transmission line of a corresponding channel; and an abnormality detection circuit configured to detect abnormality in the differential transmission lines. The abnormality detection circuit includes: N amplifiers configured to detect a potential difference between differential transmission lines of corresponding channels; N first comparators each of which is configured to compare an output voltage of a corresponding amplifier with a first threshold voltage; and a logic circuit configured to detect abnormality of a first mode in a differential transmission line of a corresponding channel based on an output from each of the N first comparators.

17 Claims, 7 Drawing Sheets

SEMICONDUCTOR INTEGRATED CIRCUIT, TIMING CONTROLLER, AND DISPLAY DEVICE

CROSS-REFERENCE TO RELATED APPLICATION(S)

This application is based upon and claims the benefit of priority from Japanese Patent Application Nos. 2015-203167, filed on Oct. 14, 2015, and 2016-196718, filed on Oct. 4, 2016, the entire contents of which are incorporated herein by reference.

TECHNICAL FIELD

The present disclosure relates to a semiconductor integrated circuit, and more particularly, to abnormality detection thereof.

BACKGROUND

A differential signal is used for high-speed data transmission between different semiconductor integrated circuits (ICs). FIG. 1 is a circuit diagram illustrating a differential transmission system using a differential signal. The differential transmission system 1 includes a first semiconductor IC (hereinafter, referred to as a "transmission circuit") 2 and a second semiconductor IC (hereinafter, referred to as a "reception circuit") 4. The transmission circuit 2 and the reception circuit 4 are connected via differential transmission lines 3. The differential transmission lines 3 include a pair of signal lines $\mathbf{3}_P$ and $\mathbf{3}_N$. The transmission circuit 2 includes a differential transmitter 6. The differential transmitter 6 drives the differential transmission lines 3 in response to data to be transmitted. The reception circuit 4 has a differential receiver 8.

In some applications, the transmission circuit 2 and the reception circuit 4 are connected via differential transmission lines 3 of a plurality of channels, and a plurality of differential transmitters 6 are embedded in the transmission circuit 2 and a plurality of differential receivers 8 are embedded in the reception circuit 4.

In the differential transmission system 1 of FIG. 1, the following abnormality and failure may occur. FIGS. 2A to 2D are views illustrating abnormality and failure.

Short circuit between the pair of signal lines $\mathbf{3}_P$ and $\mathbf{3}_N$ of the differential transmission lines 3 . . . FIG. 2A One signal line $\mathbf{3}_P(\mathbf{3}_N)$ of the differential transmission lines 3 is open . . . FIG. 2B One signal line $\mathbf{3}_P(\mathbf{3}_N)$ of the differential transmission lines 3 is power short-circuited (power fault) . . . FIG. 2C One signal line $\mathbf{3}_P(\mathbf{3}_N)$ of the differential transmission lines 3 is ground short-circuited (ground fault) . . . FIG. 2D When such abnormality and failure occur, it is impossible to perform accurate transmission, and also, a large amount of current may flow to cause heat generation and have a bad influence on other circuits.

SUMMARY

The present disclosure provides some embodiments of a semiconductor integrated circuit capable of detecting an abnormality in a differential transmission line.

According to one embodiment of the present disclosure, there is provided a semiconductor integrated circuit connected to another circuit via differential transmission lines of N channels (where N is a natural number). The semiconductor integrated circuit includes: N pairs of differential output pins each of which is connected to a differential transmission line of a corresponding channel; N differential transmitters each of which is configured to drive a differential transmission line of a corresponding channel through a corresponding differential output pin; and an abnormality detection circuit configured to detect abnormality that occurs in the differential transmission lines of the N channels. The abnormality detection circuit includes: N amplifiers configured to detect a potential difference between differential transmission lines of corresponding channels, respectively; N first comparators each of which is configured to compare an output voltage of a corresponding amplifier with a predetermined first threshold voltage; and a logic circuit configured to detect abnormality of a first mode in a differential transmission line of a corresponding channel based on an output from each of the N first comparators.

According to this embodiment, in the semiconductor integrated circuit having a function to transmit a differential signal, for each of the differential transmission lines of the plurality of channels, it is possible to detect a short circuit between a first line (non-inverting line, positive phase) and a second line (inverting line, negative phase).

According to another embodiment of the present disclosure, there is provided a semiconductor integrated circuit connected to another circuit via differential transmission lines of N channels (where N is a natural number). The semiconductor integrated circuit includes: N pairs of differential input pins each of which is connected to a differential transmission line of a corresponding channel; N differential receivers each of which is configured to receive a differential signal of a corresponding channel through a corresponding differential input pin; and an abnormality detection circuit configured to detect abnormality that occurs in the differential transmission lines of the N channels. The abnormality detection circuit includes: N amplifiers configured to detect a potential difference between differential transmission lines of corresponding channels, respectively; N first comparators each of which is configured to compare an output voltage of a corresponding amplifier with a predetermined first threshold voltage; and a logic circuit configured to detect abnormality of a first mode in a differential transmission line of a corresponding channel based on an output from each of the N first comparators.

According to this embodiment, in the semiconductor integrated circuit having a function to receive a differential signal, for each of the differential transmission lines of the plurality of channels, it is possible to detect a short circuit between a first line (non-inverting line) and a second line (inverting line).

In some embodiments, the semiconductor integrated circuit may further include a fail terminal. When an abnormality is detected in at least one differential transmission line, the logic circuit may be configured to assert a fail signal of the fail terminal. Thus, it is possible to notify an external circuit of abnormality in the differential transmission lines and perform a protection processing if necessary.

The abnormality detection circuit may further include N second comparators each of which is configured to compare a voltage of one signal line of a differential transmission line of a corresponding channel with a predetermine second threshold voltage. The second threshold voltage may be set to be higher than a variation range of a differential signal that propagates via the differential transmission line, and the logic circuit may be configured to detect abnormality of a second mode in a differential transmission line of a corresponding channel based on an output from each of the N second comparators.

Thus, it is possible to detect an abnormality caused by a power fault of the differential transmission lines.

The abnormality detection circuit may further include N third comparators each of which is configured to compare a voltage of one signal line of a differential transmission line of a corresponding channel with a predetermined third threshold voltage. The third threshold voltage may be set to be lower than a variation range of a differential signal that propagates via the differential transmission line, and the logic circuit may be configured to detect abnormality of a third mode in a differential transmission line of a corresponding channel based on an output from each of the N third comparators.

Thus, it is possible to detect an abnormality caused by a ground fault of the differential transmission lines.

The abnormality detection circuit may further include N fourth comparators each of which is configured to compare a voltage of the other signal line of a differential transmission line of a corresponding channel with the second threshold voltage. The logic circuit may be configured to detect abnormality of the second mode in the differential transmission line of the corresponding channel based on an output from each of the N fourth comparators.

The abnormality detection circuit may further include N fifth comparators each of which is configured to compare a voltage of the other signal line of the differential transmission line of the corresponding channel with the third threshold voltage. The logic circuit may be configured to detect abnormality of the third mode in the differential transmission line of the corresponding channel based on an output from each of the N fifth comparators.

The abnormality detection circuit may further include a register. When an abnormality is detected in a differential transmission line of any one of the channels, the logic circuit may be configured to write data indicating an occurrence of an abnormality in a state where a channel having abnormality is identifiable in the register.

It is possible to specify a channel where an abnormality occurs by accessing the register.

The logic circuit may be configured to write data indicating occurrence of abnormality in a state where a mode of abnormality is identifiable in the register.

It is possible to specify an abnormal mode by accessing the register.

The register may include N addresses assigned to the N channels. When an abnormality is detected in a differential transmission line of any one of the channels, the logic circuit may be configured to write data indicating the occurrence of abnormality in an address corresponding to the channel.

The register may include a plurality of addresses assigned to a plurality of modes of abnormality. When a certain mode of abnormality is detected, the logic circuit may be configured to write data indicating the occurrence of an abnormality in an address corresponding to the mode.

The semiconductor integrated circuit further includes an interface circuit, wherein data in the register may be accessible from outside.

It is possible to check an abnormal state by accessing the external register.

A low voltage differential signaling (LVDS) signal may be propagated via the differential transmission lines. In the LVDS system, a resistor is installed between the inputs of a differential receiver, i.e., a pair of the differential transmission lines. When an open failure occurs, a potential of the open-failed line is close to a potential of a normal line through the resistor. Thus, it is possible to detect the open failure as a failure of the first mode.

According to another embodiment of the present disclosure, there is provided a timing controller for transmitting image data to a display driver via a plurality of differential transmission lines. The timing controller may include the semiconductor integrated circuit as described above.

Further, arbitrarily combining the foregoing components or substituting the components or expressions of the present disclosure with one another among a method, an apparatus, and a system is also effective as an embodiment of the present disclosure.

DETAILED DESCRIPTION

Figure 1:
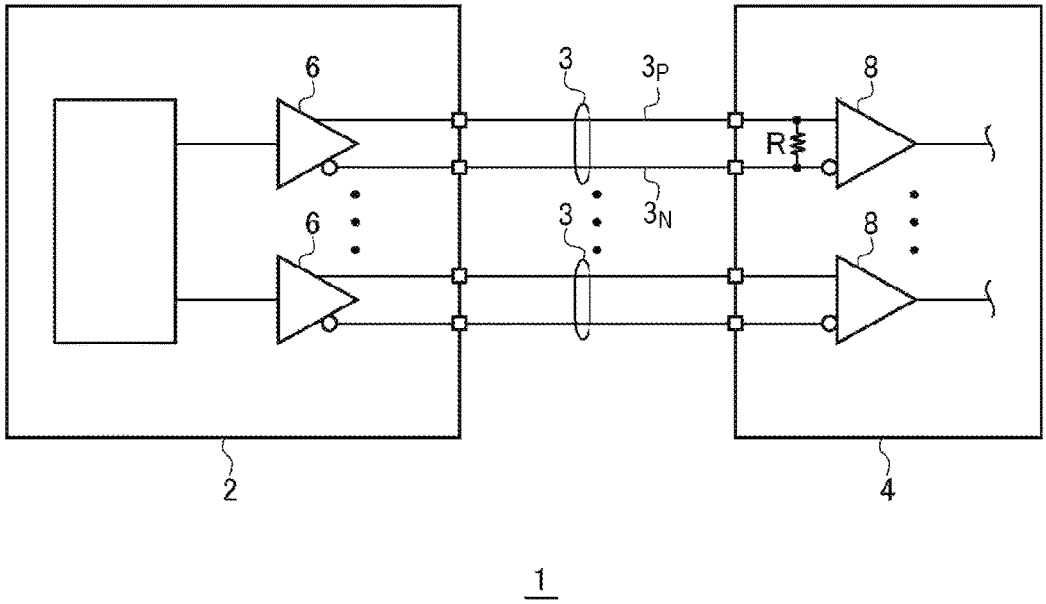
FIG. 1 (PRIOR ART)
FIG. 1 is a circuit diagram illustrating a differential transmission system using a differential signal.
Figure 2A:
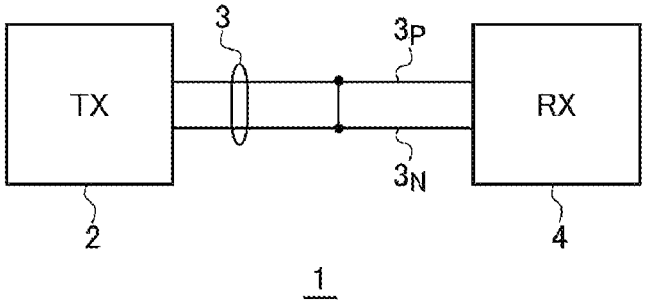
FIG. 2A (PRIOR ART)
FIGS. 2A to 2D are views illustrating abnormality and failure.
Figure 2B:
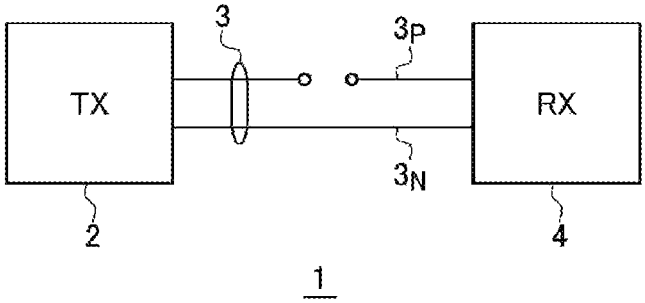
FIG. 2B (PRIOR ART)
Figure 2C:
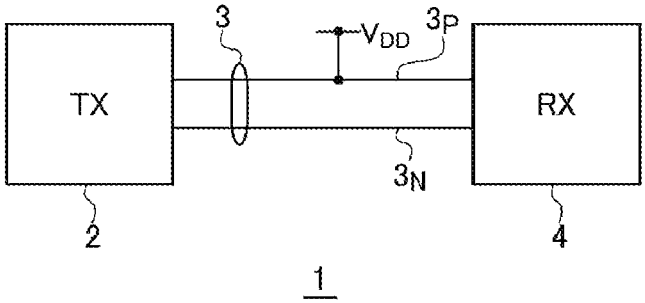
FIG. 2C (PRIOR ART)
Figure 2D:
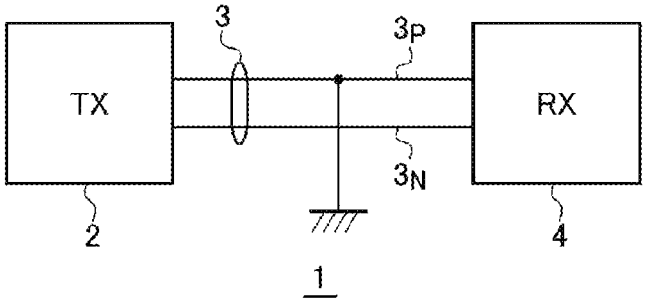
FIG. 2D (PRIOR ART)

Embodiments of the present disclosure will be now described in detail with reference to the drawings. Like or equivalent components, members, and processes illustrated in each drawing are given like reference numerals and a repeated description thereof will be properly omitted. Further, the embodiments are presented by way of example only, and are not intended to limit the present disclosure, and any feature or combination thereof described in the embodiments may not necessarily be essential to the present disclosure.

In the present disclosure, "a state where a member A is connected to a member B" includes a case where the member A and the member B are physically directly connected or even a case where the member A and the member B are indirectly connected through any other member that does not affect an electrical connection state between the members A and B or does not impair functions and effects achieved by combinations of the members A and B.

Similarly, "a state where a member C is installed between a member A and a member B" includes a case where the member A and the member C or the member B and the member C are indirectly connected through any other member that does not affect an electrical connection state between the members A and C or the members B and C or does not impair function and effects achieved by combinations of the members A and C or the members B and C, in addition to a case where the member A and the member C or the member B and the member C are directly connected.

Figure 3:
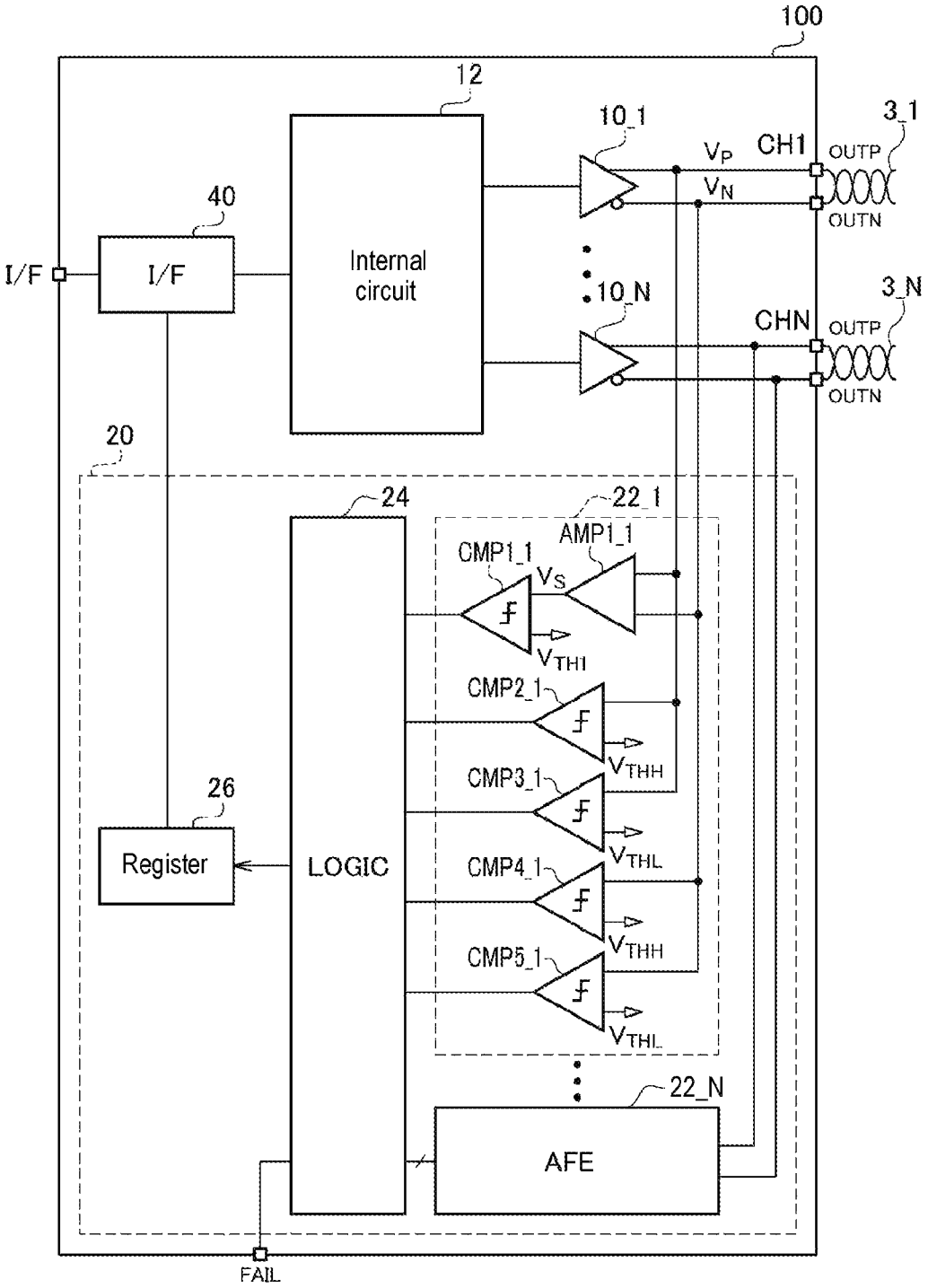
FIG. 3 is a circuit diagram of a semiconductor integrated circuit according to an embodiment of the present disclosure.

FIG. 3 is a circuit diagram of a semiconductor integrated circuit (IC) 100 according to an embodiment of the present disclosure. The semiconductor IC 100 is connected to another circuit (reception circuit) via differential transmission lines 3 of N channels. In this embodiment, the number of channels is set as N (where N is a natural number). Further, a channel number is indicated by a subscript.

The semiconductor IC 100 includes N differential output pins OUTP/OUTN, N differential transmitters 10_1 to 10_N, an internal circuit 12, an abnormality detection circuit 20, and an interface circuit 40.

The internal circuit 12 is a digital circuit or a combined analog/digital circuit for performing a predetermined signal processing, and generates data to be transmitted to the reception circuit. This data is serially transmitted to another circuit via differential transmission lines 3_1 to 3_N of N channels. As the serial transmission, low voltage differential signaling (LVDS) transmission, mini-LVDS transmission, or the like may be used but the transmission scheme does not matter.

The N differential output pins OUTP/OUTN are connected to the differential transmission lines 3 of corresponding channels, respectively. The N differential transmitters 10_1 to 10_N correspond to the differential transmission lines 3_1 to 3_N of a plurality of channels CH1 to CHN. An ith (where $1 \le i \le N$) differential transmitter 10_*i* drives a differential transmission line 3_*i* of a corresponding channel CHi via a corresponding differential output pin OUTP/OUTN. The configuration of the differential transmitter 10 is not particularly limited. The differential transmitter 10 may be configured to make a pair with a differential receiver mounted on a reception circuit (not shown) to transmit a differential signal using a known technique.

The abnormality detection circuit 20 detects abnormalities that occur in the differential transmission lines 3_1 to 3_N of the N channels CH1 to CHN. The abnormality detection circuit 20 may detect abnormalities in three different modes.

The abnormality detection circuit 20 includes N analog front-end circuits 22_1 to 22_N corresponding to the N channels CH1 to CHN, a logic circuit 24, and a register 26.

The analog front-end circuits 22_1 to 22_N are similarly configured, each of which includes a first comparator CMP1, an amplifier AMP1, a second comparator CMP2, a third comparator CMP3, a fourth comparator CMP4, and a fifth comparator CMP5.

(Abnormality of First Mode)

The amplifier AMP1_*i* detects a potential difference of the differential transmission line 3_*i* of the corresponding channel CHi. The first comparator CMP1_*i* compares an output voltage $V_S$ of the corresponding amplifier AMP1_*i* with a predetermined first threshold voltage $V_{TH1}$. The logic circuit 24 detects an abnormality in a first mode that occurs in the differential transmission line 3_*i* of the corresponding channel CHi based on an output from the first comparator CMP1_*i*. For example, when a state of $V_S < V_{TH1}$ continues for a predetermined period of time, the logic circuit 24 may determine that an abnormality in the first mode occurred. The predetermined period of time may be a few cycles of a period of the differential signal.

When a gain of the amplifier AMP1 is g and an amplitude of the differential signal is ΔV, $V_S = g \times (V_P - V_N) = g \times 2\Delta V$. When $\Delta V_{TH} = V_{TH1}/(2g)$, it is determined that an abnormality in the first mode occurs if $\Delta V < \Delta V_{TH}$.

(Abnormality of Second Mode)

The second comparator CMP2_*i* compares a voltage $V_P$ of one signal line $\mathbf{3}_P$ of the differential transmission line 3 of the corresponding channel CHi with a predetermined second threshold voltage $V_{THH}$. The fourth comparator CMP4_*i* compares a voltage $V_N$ of the other signal line $\mathbf{3}_P$ of the differential transmission line 3 of the corresponding channel CHi with the second threshold voltage $V_{THH}$. The second threshold voltage $V_{THH}$ is set to be higher than a variation range of a differential signal that propagates via the differential transmission line 3_*i*. That is to say, when a half amplitude of the differential signal is ΔV and a common voltage of the differential signal is $V_{COM}$, $V_{THH} > V_{COM} + \Delta V$ is satisfied.

The logic circuit 24 detects an abnormality in a second mode that occurs in the differential transmission line 3_*i* of the corresponding channel CHi based on an output from the second comparator CMP2_*i*. For example, when the state of $V_P > V_{THH}$ continues for a predetermined period of time, the logic circuit 24 may determine that an abnormality in the second mode occurred. Similarly, the logic circuit 24 may refer to an output from the fourth comparator CMP4_*i* and determine that an abnormality in the second mode occurred when a state of $V_N > V_{THH}$ continues for a predetermined period of time.

(Abnormality of Third Mode)

The third comparator CMP3_*i* compares a voltage $V_P$ of one signal line $\mathbf{3}_P$ of the differential transmission line 3 of the corresponding channel CHi with a predetermined third threshold voltage $V_{THL}$. The fifth comparator CMP5_*i* compares a voltage $V_N$ of the other signal line $\mathbf{3}_P$ of the differential transmission line 3 of the corresponding channel CHi with the third threshold voltage $V_{THL}$. The third threshold voltage $V_{THL}$ is set to be lower than a variation range of a differential signal that propagates via the differential transmission line 3_*i*. That is to say, when a half amplitude of the differential signal is ΔV and a common voltage of the differential signal is $V_{COM}$, $V_{THL} < V_{COM} - \Delta V$ is satisfied.

The logic circuit 24 detects abnormality in a third mode that occurs in the differential transmission line 3_*i* of the corresponding channel CHi based on an output from the third comparator CMP3_*i*. For example, when the state of $V_P < V_{THL}$ continues for a predetermined period of time, the logic circuit 24 may determine that an abnormality in the third mode occurred. Similarly, the logic circuit 24 may refer to an output from the fifth comparator CMP5_*i* and determine that an abnormality in the third mode occurs when a state of $V_N < V_{THL}$ continues for a predetermined period of time.

A fail (FAIL) terminal is installed in the semiconductor IC 100. When an abnormality in the differential transmission line 3 of any one of the N channels CH1 to CHN is detected, the logic circuit 24 asserts a fail signal of the FAIL terminal. For example, the logic circuit 24 may output a fail signal of two values of high level and low level from the FAIL terminal or may switch the FAIL terminal to two states of a low level state and high impedance state in an open collector (open drain) form.

The register 26 may be connected to an external circuit (not shown) via the interface circuit 40 and a bus, allow the external circuit to make a reference, and write data by the external circuit. The interface circuit 40 may be a serial interface such as, for example, an $I^2C$ (Inter IC) interface. Alternatively, the interface circuit 40 may be a parallel interface.

When an abnormality in a differential transmission line 3_*i* of one channel CHj (where $1 \le j \le N$) is detected, the logic circuit 24 writes data indicating the occurrence of the abnormality in a state where the abnormal channel CHj is identifiable in the register 26 (namely, sets an abnormal flag). More preferably, the logic circuit 24 writes data indicating the occurrence of an abnormality in a state where the abnormal mode is identifiable in the register 26.

FIGS. 4A to 4D are views illustrating the register 26. The register 26 of FIG. 4A may have a plurality of addresses $ADR_{11}$ to $ADR_{N5}$ corresponding to the comparators CMP1 to CMP5 with respect to all channels, CH1 to CHN. Given that $1 \leq j \leq N$ and $1 \leq k \leq 5$, when an abnormality is detected by a kth comparator CMPk of a channel CHj, a value indicating an abnormality, e.g., 1, is written in an address $ADR_{jk}$.

Figure 4A:
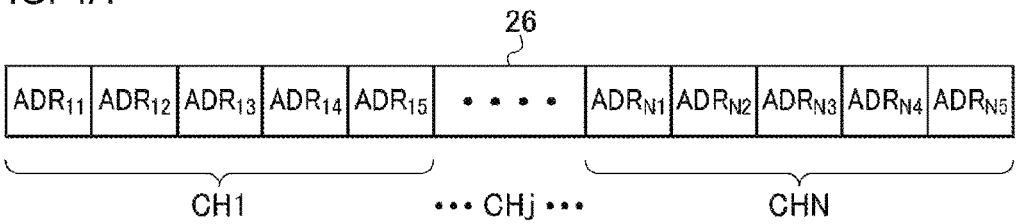
FIGS. 4A to 4D are views illustrating a register.
Figure 4B:
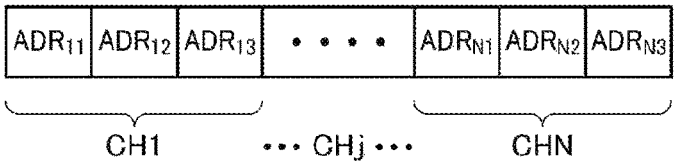

In FIG. 4A, it may be considered that both $ADR_{j2}$ and $ADR_{j4}$ in the same channel indicates an abnormality in a second mode. Similarly, it may be considered that both $ADR_{j3}$ and $ADR_{j5}$ in the same channel indicates an abnormality in a third mode. Thus, the register 26 of FIG. 4B may have a plurality of addresses $ADR_{11}$ to $ADR_{N3}$ corresponding to three modes with respect to all channels, CH1 to CHN. Given that $1 \leq j \leq N$ and $1 \leq m \leq 3$, a value indicating an abnormality, e.g., 1, is written in an address $ADR_{jm}$ when an abnormality of an mth mode of a channel CHj is detected.

Figure 4C:
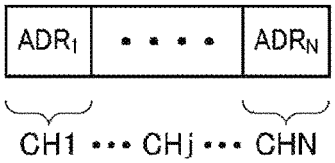

When only a channel having an abnormality is desired to be written, the register 26 may have N addresses $ADR_1$ to $ADR_N$ corresponding to the channels CH1 to CHN as illustrated in FIG. 4C. Given that $1 \leq j \leq N$, a value indicating an abnormality, e.g., 1, is recorded in an address $ADR_j$ when an abnormality of one or more of the first to third modes is detected in a channel CHj.

Figure 4D:
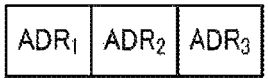

When only a mode having an abnormality is desired to be written, the register 26 may have three addresses $ADR_1$ to $ADR_3$ corresponding to three modes as illustrated in FIG. 4D. Given that $1 \leq m \leq 3$, a value indicating an abnormality, e.g., 1, is written in an address ADRm when an abnormality of an mth mode is detected in one of the channels CH1 to CHN.

Figure 5A:
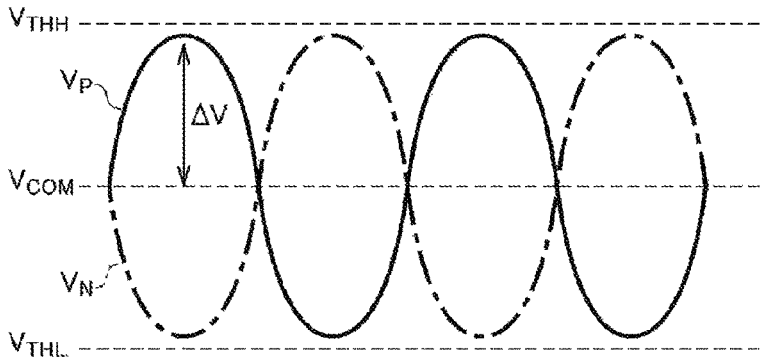
FIGS. 5A to 5D are operational waveform diagrams of a semiconductor integrated circuit.

The configuration of the semiconductor IC 100 has been described above. Next, an operation thereof will be described. FIGS. 5A to 5D are operational waveform diagrams of the semiconductor IC 100. FIG. 5A is a waveform diagram when the differential transmission lines 3 are normal. At this time, since a potential difference between $V_P$ and $V_N$, i.e., an amplitude $\Delta V$, is greater than $\Delta V_{TH}$, the differential transmission lines 3 are determined to be normal with respect to the first mode.

Further, since $V_{THL} < V_P < V_{THH}$ and $V_{THL} < V_N < V_{THH}$ are established, the differential transmission lines 3 are also determined to be normal with respect to the second mode and the third mode.

Figure 5B:
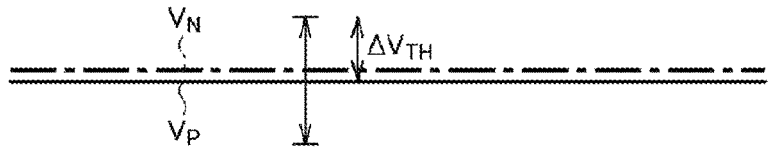

FIG. 5B illustrates a case where a non-inverting line (positive phase line) $\mathbf{3}_P$ and an inverting line (negative phase line) $\mathbf{3}_N$ of the differential transmission lines 3 are short-circuited. At this time, a potential difference between $V_P$ and $V_N$ is substantially zero, establishing $\Delta V < \Delta V_{TH}$. Thus, it is determined that an abnormality in the first mode occurs.

Further, in the LVDS transmission system, as illustrated in FIG. 1, a resistor R connecting the differential transmission lines $\mathbf{3}_P$ and $\mathbf{3}_N$ is installed at an input of the differential receiver 8 of the reception circuit. Even when the resistor R is short-circuited, the waveform of FIG. 5B may be observed. Thus, failure in the reception circuit is also a detection target of an abnormality in the first mode.

Figure 5C:
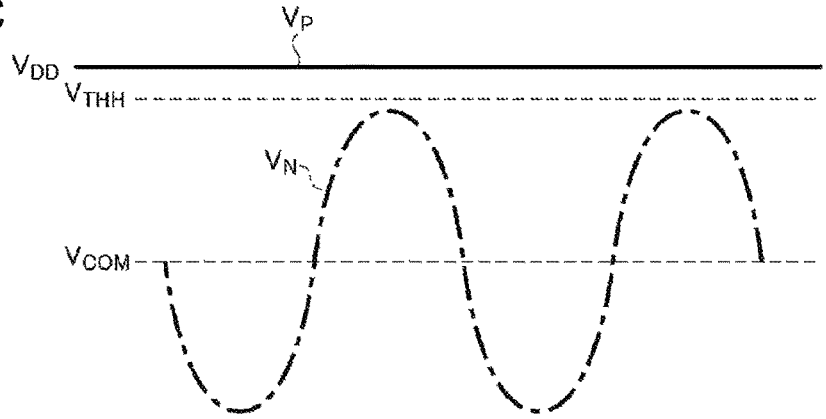

FIG. 5C is a waveform diagram when one line (here, non-inverting line $\mathbf{3}_P$) of the differential transmission lines 3 is short-circuited to the power line (power fault). At this time, since $V_P \approx V_{DD}$ and $V_P > V_{THH}$ is established, it is determined that an abnormality in the second mode occurred.

Figure 5D:
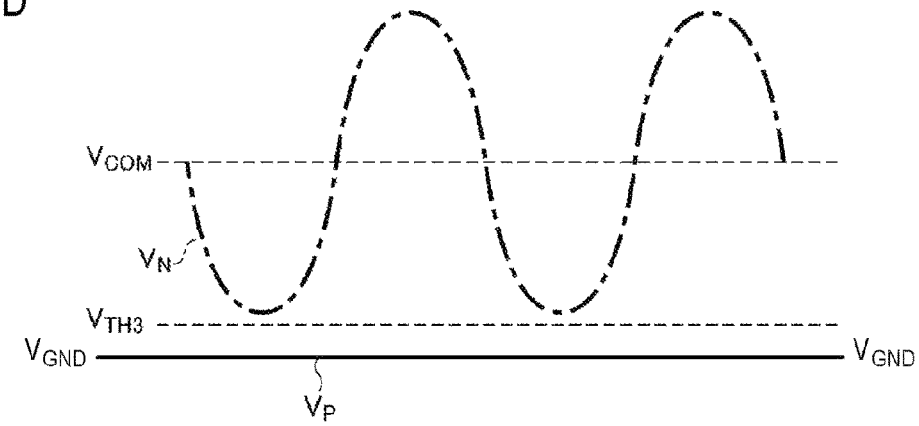

FIG. 5D is a waveform diagram when one line (here, non-inverting line $\mathbf{3}_P$) of the differential transmission lines 3 is short-circuited to the ground line (ground fault). At this time, since $V_P \approx V_{GND}$ (0 V) and $V_P < V_{THL}$ is established, it is determined that an abnormality in the third mode occurred.

Further, although not shown, when one line of the differential transmission lines 3 is open, its potential becomes indefinite. Thus, the open failure is detected as an abnormality in any one of the first to third modes. Further, in the LVDS transmission system, as mentioned above, the resistor connecting the differential transmission lines 3P and 3N is installed at the input of the differential receiver of the reception circuit, and thus, when one line of the differential transmission lines 3 is open, a potential of the open-failed line is close to a potential of a normal line through the resistor of the receiver side. Thus, in the LVDS system, the open failure may be detected as the first mode.

The operation of the semiconductor IC 100 has been described above.

According to the semiconductor IC 100 of the embodiment of the present disclosure, a short circuit between the pair of differential transmission lines 3 may be detected as an abnormality in the first mode, a power fault of one line of the differential transmission lines 3 may be detected as an abnormality in the second mode, and a ground fault of one line of the differential transmission lines 3 may be detected as an abnormality in the third mode.

Further, when a certain abnormality is detected, the occurrence of an abnormality may be notified to an external circuit by asserting a signal of a FAIL terminal. Upon receipt of the notification, the external circuit may respond thereto and perform a necessary protection processing. In other words, the protection processing of the semiconductor IC 100 when an abnormality occurs may be left in the external circuit (for example, a host processor).

In the semiconductor IC 100, a flag indicating an abnormality is written in the register 26 such that an abnormal channel and an abnormal mode are identifiable. Thus, when an assertion of the FAIL signal is detected, the external circuit may specifically know a place where an abnormality occurred or a state of abnormality by accessing the register 26 through the interface circuit 40.

Figure 6:
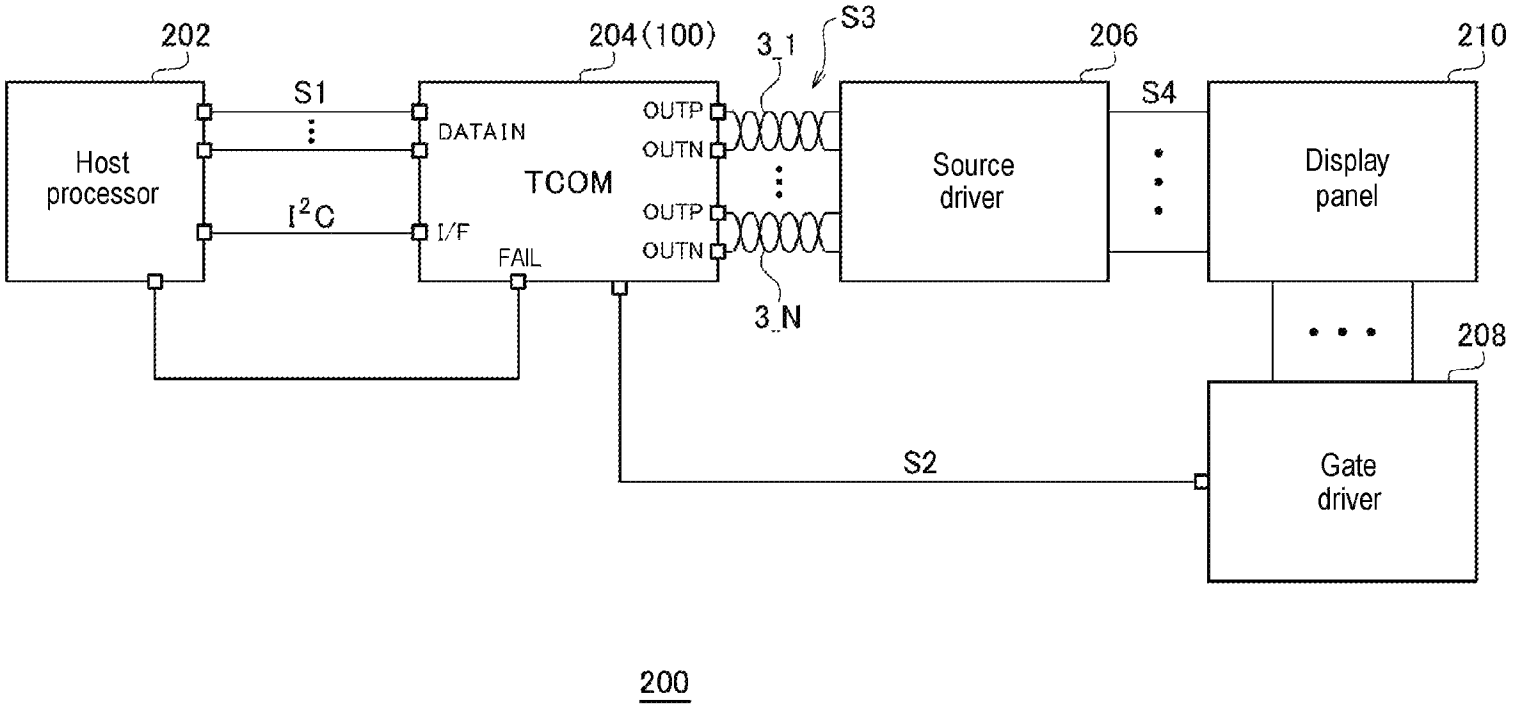
FIG. 6 is a block diagram of a display device including a semiconductor integrated circuit.

Next, the applications of the semiconductor IC 100 will be described. FIG. 6 is a block diagram of a display device 200 including the semiconductor IC 100. The display device 200 includes a host processor 202, a timing controller 204, a source driver 206, a gate driver 208, and a display panel 210. The display panel 210 is a matrix type display device such as a liquid crystal panel or an organic EL panel, and has a plurality of data lines, a plurality of scan lines, and a plurality of pixels.

The host processor (graphic processor) 202 generates image data S1 to be displayed on the display panel 210. The image data S1 is serially transmitted from the host processor 202 to the timing controller 204. The timing controller 204 receives the image data S1 through a data input terminal DATAIN.

The timing controller 204 is a functional IC equivalent to the aforementioned semiconductor IC 100. The timing controller 204 further includes a receiver for receiving the image data S1, in addition to the functional block of the semiconductor IC 100 illustrated in FIG. 3. An internal circuit 12 of the timing controller 204 performs a predetermined signal processing on the image data S1, generates pixel data (RGB data) after data processing, and also generates a control signal for the source driver 206 or the gate driver 208. The control signal includes a vertical synchronization signal VSYNC, a horizontal synchronization signal HSYNC, a data enable (DE) signal, and the like. A plurality of differential transmitters 10 of the semiconductor IC 100 transmits the RGB data generated by the internal circuit 12, as pixel data S3 in a serial differential format, to the source driver 206.

The gate driver (scan driver) 208 sequentially selects a plurality of scan lines of the display panel 210, in synchronization with the control signal S2 from the timing controller 204.

The source driver (data driver) 206 applies a driving voltage S4 corresponding to the pixel data S3 transmitted from the timing controller 204 to each of the plurality of data lines of the display panel 210. The source driver 206 may be divided into a plurality of ICs.

In this display device 200, tens to hundreds of differential transmission lines 3 are installed between the timing controller 204 and the source driver 206. By adopting the architecture of the semiconductor IC 100 according to the embodiment of the present disclosure to the timing controller 204, it is possible to detect various abnormalities or failures that may occur in the plurality of differential transmission lines 3.

Further, as illustrated in FIG. 6, by connecting the FAIL terminal to the host processor 202, the host processor 202 can detect abnormality that occurs in the differential transmission lines 3. In addition, an I/F terminal of the timing controller 204 and the host processor 202 are connected via an $I^2C$ bus. Thus, the host processor 202 may detect a place where an abnormality occurs or an abnormal mode by referring to the register 26 of the timing controller 204.

The display device 200 of FIG. 6 may be used in a console display for vehicles. Also, the display device 200 may be mounted on an electronic device such as a smartphone, a tablet PC, a note-type display, or a vehicle navigation system. Further, the display device 200 of FIG. 6 may be mounted on general-purpose displays, televisions, or the like.

The present disclosure has been described above based on the embodiments. It is to be understood by those skilled in the art that the embodiments are merely illustrative and may be variously modified by any combination of the components or processes, and the modifications are also within the scope of the present disclosure. Hereinafter, these modifications will be described.

(First Modification)

In the embodiment, it has been illustrated that the abnormality in the first to third modes may be detected in the semiconductor IC 100, but the present disclosure is not limited thereto. For example, the second comparator CMP2 to the fifth comparator CMP5 may be omitted and only the first mode may be detected. Even in this case, a short circuit between pairs of the differential transmission lines 3 may be detected, and in a configuration in which the receiver includes the inter-differential resistor R as in the LVDS system, open failure in any line of the differential transmission lines 3 may be detected. Certain applications may only need these detections.

Alternatively, it may be configured to detect only the second mode or the third mode, or any combination of the first mode to the third mode may be detected.

(Second Modification)

In the embodiment, it has been illustrated that one analog front-end circuit 22 is installed per channel, but the present disclosure is not limited thereto. One analog front-end circuit 22 may be installed in every plurality of channels (e.g., two channels or four channels), and one analog front-end circuit 22 may be shared by the plurality of channels in a time division manner. Thus, a circuit area may be reduced.

(Third Modification)

In the embodiment, it has been illustrated that, when an abnormality is detected in the semiconductor IC 100, the protection processing is left in the external circuit. However, a certain protection processing may be performed in the semiconductor IC 100. For example, the differential transmitter 10 of a channel where an abnormality is detected may be stopped.

(Fourth Modification)

The following processing may be performed on the display device 200 of FIG. 6. Brightness (pixel values) of adjacent pixels tends to be close to each other in numerous image data. Thus, when an abnormality occurs in the differential transmission line 3 of a certain channel, the channel is notified to the source driver 206 which is the reception circuit. The source driver 206 may specify a plurality of pixels (abnormal pixels) corresponding to the abnormal channel and drive a data line corresponding to the abnormal pixels using different pixel values adjacent to the abnormal pixels.

(Fifth Modification)

In the embodiment, the display device 200 has been described as the application of the semiconductor IC 100, but the present disclosure is not limited thereto. Data transmitted via the differential transmission lines 3 is not limited to the image data and may be any other data such as audio data or numerical data.

(Sixth Modification)

In the embodiment, the semiconductor IC 100 having a differential transmitter has been described, but the present disclosure is not limited thereto. The present disclosure is also applicable to a semiconductor IC having a differential receiver.

Figure 7:
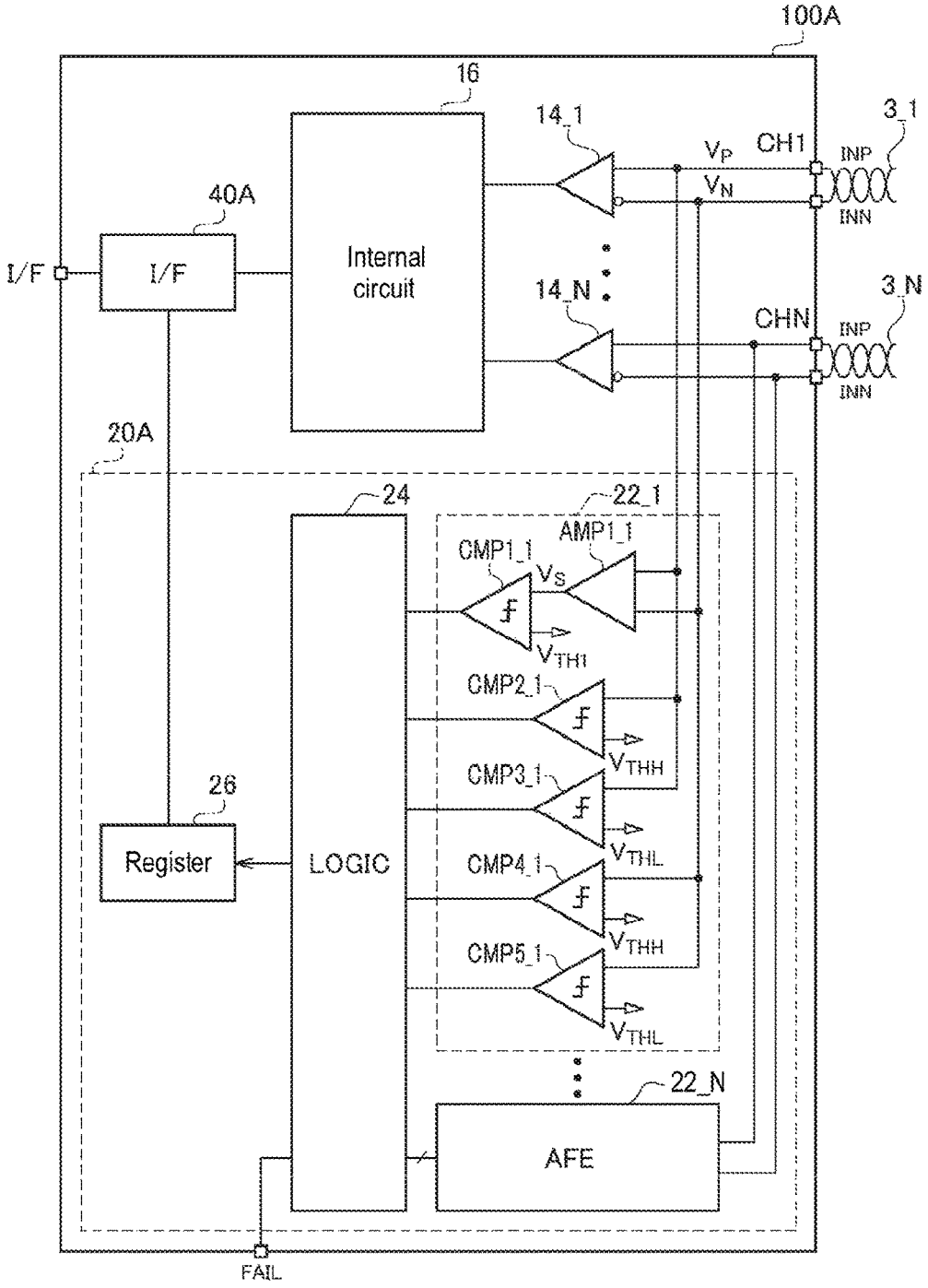
FIG. 7 is a circuit diagram of a semiconductor integrated circuit according to a sixth modification.

FIG. 7 is a circuit diagram of a semiconductor IC 100A according to a sixth modification. The semiconductor IC 100A is connected to another circuit (transmission circuit) via differential transmission lines 3 of N channels.

The semiconductor IC 100A includes N differential input pins INP/INN, N differential receivers 14_1 to 14_N, an internal circuit 16, an abnormality detection circuit 20A, and an interface circuit 40.

The N differential input pins INP/INN are connected to the differential transmission lines 3 of corresponding channels, respectively. As the serial transmission via differential transmission lines 3, low voltage differential signaling (LVDS) transmission, mini-LVDS transmission, or the like may be used but the transmission scheme does not matter.

The N differential receivers 14_1 to 14N correspond to the differential transmission lines 3_1 to 3_N of a plurality of channels CH1 to CHN. An ith (where $1 \leq i \leq N$) differential receiver 14_*i* receives a corresponding differential signal via a corresponding differential input pin INP/INN. The configuration of the differential receiver 14 is not particularly limited. The differential receiver 14 may be configured to make a pair with a differential transmitter mounted on a transmission circuit (not shown) to receive a differential signal using a known technique.

The internal circuit 16 is a digital circuit or a combined analog/digital circuit for performing a predetermined signal processing, and processes data received by the differential receiver 14.

The abnormality detection circuit 20A detects abnormalities that occur in the differential transmission lines 3_1 to 3_N of the N channels CH1 to CHN. The abnormality detection circuit 20A has the same configuration as that of the abnormality detection circuit 20 of FIG. 3 and performs the same processes.

According to the sixth modification, the semiconductor integrated circuit having a function to receive a differential signal can detect abnormalities in different modes for each of the differential transmission lines of the plurality of channels.

The semiconductor IC 100A of FIG. 7 may be the timing controller of FIG. 6. The timing controller 204 is connected to the host processor 202 via the differential lines and serially receives differential image data through the terminal DATAIN. Thus, the reception circuit of the timing controller 204 can be configured by the architecture illustrated in FIG. 7.

According to some embodiments of the present disclosure, it is possible to detect an abnormality in a differential transmission line.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A semiconductor integrated circuit connected to another circuit via differential transmission lines of N channels (where N is a natural number), the circuit comprising:

N pairs of differential output pins each of which is connected to a differential transmission line of a corresponding channel;

N differential transmitters each of which is configured to drive a differential transmission line of a corresponding channel through a corresponding differential output pin; and an abnormality detection circuit configured to detect abnormality that occurs in the differential transmission lines of the N channels, wherein the abnormality detection circuit comprises:

N amplifiers configured to detect a potential difference between differential transmission lines of corresponding channels, respectively;

N first comparators each of which is configured to compare an output voltage of a corresponding amplifier with a predetermined first threshold voltage; and a logic circuit configured to detect abnormality of a first mode in a differential transmission line of a corresponding channel based on an output from each of the N first comparators.

2. The circuit of claim 1, further comprising a fail terminal, wherein, when abnormality is detected in at least one differential transmission line, the logic circuit is configured to assert a fail signal of the fail terminal.

3. The circuit of claim 1, wherein the abnormality detection circuit further comprises N second comparators each of which is configured to compare a voltage of one signal line of a differential transmission line of a corresponding channel with a predetermine second threshold voltage, wherein the second threshold voltage is set to be higher than a variation range of a differential signal that propagates via the differential transmission line, and the logic circuit is configured to detect abnormality of a second mode in a differential transmission line of a corresponding channel based on an output from each of the N second comparators.

4. The circuit of claim 3, wherein the abnormality detection circuit further comprises N fourth comparators each of which is configured to compare a voltage of the other signal line of a differential transmission line of a corresponding channel with the second threshold voltage, wherein the logic circuit is configured to detect abnormality of the second mode in the differential transmission line of the corresponding channel based on an output from each of the N fourth comparators.

5. The circuit of claim 1, wherein the abnormality detection circuit further comprises N third comparators each of which is configured to compare a voltage of one signal line of a differential transmission line of a corresponding channel with a predetermine third threshold voltage, wherein the third threshold voltage is set to be lower than a variation range of a differential signal that propagates via the differential transmission line, and the logic circuit is configured to detect abnormality of a third mode in a differential transmission line of a corresponding channel based on an output from each of the N third comparators.

6. The circuit of claim 5, wherein the abnormality detection circuit further comprises N fifth comparators each of which is configured to compare a voltage of the other signal line of the differential transmission line of the corresponding channel with the third threshold voltage, wherein the logic circuit is configured to detect abnormality of the third mode in the differential transmission line of the corresponding channel based on an output from each of the N fifth comparators.

7. The circuit of claim 1, wherein the abnormality detection circuit further comprises a register, wherein, when abnormality is detected in a differential transmission line of any one of the channels, the logic circuit is configured to write data indicating occurrence of abnormality in a state where a channel having abnormality is identifiable in the register.

8. The circuit of claim 7, wherein the logic circuit is configured to write the data indicating occurrence of abnormality in a state where a mode of abnormality is identifiable in the register.

9. The circuit of claim 8, wherein the register includes a plurality of addresses assigned to a plurality of modes of abnormality, wherein, when a certain mode of abnormality is detected, the logic circuit is configured to write the data indicating occurrence of abnormality in an address corresponding to the mode.

10. The circuit of claim 7, wherein the register includes N addresses assigned to the N channels, wherein, when abnormality is detected in a differential transmission line of any one of the channels, the logic circuit is configured to write the data indicating occurrence of abnormality in an address corresponding to the channel.

11. The circuit of claim 7, further comprising an interface circuit, wherein the data in the register is accessible from outside.

12. The circuit of claim 1, wherein the abnormality detection circuit further comprises a register, wherein, when abnormality is detected in a differential transmission line of any one of the channels, the logic circuit is configured to write data indicating occurrence of abnormality in a state where a mode of abnormality is identifiable in the register.

13. The circuit of claim 1, wherein a low voltage differential signaling (LVDS) signal is propagated via the differential transmission lines.

14. A timing controller for transmitting image data to a display driver via a plurality of differential transmission lines, comprising:

the semiconductor integrated circuit of claim 1.

15. A display device comprising the timing controller of claim 14.

16. A semiconductor integrated circuit connected to another circuit via differential transmission lines of N channels (where N is a natural number), the circuit comprising:

N pairs of differential input pins each of which is connected to a differential transmission line of a corresponding channel;

N differential receivers each of which is configured to receive a differential signal of a corresponding channel through a corresponding differential input pin; and an abnormality detection circuit configured to detect abnormality that occurs in the differential transmission lines of the N channels, wherein the abnormality detection circuit comprises:

N amplifiers configured to detect a potential difference between differential transmission lines of corresponding channels, respectively;

N first comparators each of which is configured to compare an output voltage of a corresponding amplifier with a predetermined first threshold voltage; and a logic circuit configured to detect abnormality of a first mode in a differential transmission line of a corresponding channel based on an output from each of the N first comparators.

17. A semiconductor integrated circuit connected to another circuit via differential transmission lines of N channels (where N is a natural number), the circuit comprising:

N pairs of differential output pins each of which is connected to a differential transmission line of a corresponding channel;

N differential transmitters each of which is configured to drive a differential transmission line of a corresponding channel through a corresponding differential output pin; and an abnormality detection circuit configured to detect abnormality that occurs in the differential transmission lines of the N channels, wherein the abnormality detection circuit comprises:

M amplifiers configured to detect a potential difference between differential transmission lines of corresponding channels, respectively;

M first comparators each of which is configured to compare an output voltage of a corresponding amplifier with a predetermined first threshold voltage; and a logic circuit configured to detect abnormality of a first mode in a differential transmission line of a corresponding channel based on an output from each of the M first comparators, wherein M is less than N (where $1 \leq M < N$) and the amplifiers and the first comparators are shared by the plurality of channels in a time division manner.

* * * * *